US010451334B2

(12) United States Patent
Xia et al.

(10) Patent No.: US 10,451,334 B2
(45) Date of Patent: Oct. 22, 2019

(54) LEFT-RIGHT DOOR OPENING MECHANISM AND REFRIGERATOR

(71) Applicant: QINGDAO HAIER JOINT STOCK CO., LTD., Qingdao, Shandong Province (CN)

(72) Inventors: Enpin Xia, Qingdao (CN); Hao Zhang, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/302,100

(22) PCT Filed: Dec. 29, 2016

(86) PCT No.: PCT/CN2016/112820
§ 371 (c)(1),
(2) Date: Nov. 15, 2018

(87) PCT Pub. No.: WO2017/206501
PCT Pub. Date: Dec. 7, 2017

(65) Prior Publication Data

US 2019/0145695 A1 May 16, 2019

(30) Foreign Application Priority Data

May 31, 2016 (CN) ..... 2016 1 0377865

(51) Int. Cl.
*E05D 15/50* (2006.01)
*F25D 23/02* (2006.01)
(Continued)

(52) U.S. Cl.
CPC ..... *F25D 23/028* (2013.01); *E05D 7/02* (2013.01); *E05D 7/1061* (2013.01); *E05D 15/50* (2013.01);
(Continued)

(58) Field of Classification Search
CPC ..... F25D 23/028; F25D 23/02; E05D 15/50; E05D 15/505; E05D 7/02; E05D 7/1061
See application file for complete search history.

(56) References Cited

U.S. PATENT DOCUMENTS 4,495,673 A * 1/1985 Khan ..... E05D 15/505 16/232
4,503,582 A * 3/1985 Gurubatham ..... E05D 15/505 16/232
(Continued)

FOREIGN PATENT DOCUMENTS

CN 1207488 A 2/1999
CN 202692585 U 1/2013
(Continued)

*Primary Examiner* — Kimberley S Wright
(74) *Attorney, Agent, or Firm* — Cheng-Ju Chiang

(57) ABSTRACT

A left-right door opening mechanism comprises a hinge module arranged on a door body and a transmission module arranged on a cabinet body. The transmission module comprises a transmission bottom plate, two first gears oppositely arranged on the transmission bottom plate, a transmission rack which is in transmission through the first gears, and second gears which are in transmission with the first gears respectively. The transmission rack is guided and limited by the second gears. The hinge module comprises a hinge bottom plate and two hinges oppositely arranged on the hinge bottom plate. The hinges are in transmission with the first gears. When the two hinges are respectively meshed with the first gears, the door body is locked. When the hinge
(Continued)

on one side is disengaged from the first gear but the hinge on the other side is still meshed with the other first gear, the door body is opened.

10 Claims, 10 Drawing Sheets

(51) Int. Cl.
*E05D 7/02* (2006.01)
*E05D 7/10* (2006.01)

(52) U.S. Cl.
CPC ..... *F25D 23/02* (2013.01); *E05Y 2900/31* (2013.01); *F25D 2323/022* (2013.01); *F25D 2323/024* (2013.01)

(56) References Cited

U.S. PATENT DOCUMENTS 4,514,021 A 4/1985 Sundermeier et al.
4,947,583 A * 8/1990 Inui ..... E05D 15/505 16/232
5,064,255 A * 11/1991 Inui ..... E05D 15/502 312/405
5,548,927 A * 8/1996 Song ..... E05D 15/505 49/193
5,675,934 A * 10/1997 Park ..... E05D 15/505 16/232
5,829,197 A * 11/1998 Oh ..... E05D 15/505 49/193
6,000,771 A * 12/1999 Wissinger ..... E05D 15/505 312/401
7,506,474 B2 * 3/2009 Yoshikawa ..... E05D 3/022 312/324
7,913,355 B2 * 3/2011 Choi ..... E05D 15/505 16/230
8,729,439 B2 * 5/2014 Kim ..... H05B 6/6414 219/715
2005/0284159 A1 * 12/2005 Kim ..... F25D 23/028 62/126
2008/0048539 A1 * 2/2008 Beek ..... E05D 7/02 312/405
2019/0145140 A1 * 5/2019 Zhang ..... E05D 3/02

FOREIGN PATENT DOCUMENTS

CN 104344660 A 2/2015
CN 105509396 A 4/2016
CN 106016927 A 10/2016
JP H4-148180 A 5/1992
JP 2006-57904 A 3/2006
WO 2007/018395 A1 2/2007

* cited by examiner

LEFT-RIGHT DOOR OPENING MECHANISM AND REFRIGERATOR

CROSS REFERENCE OF THE RELATED APPLICATIONS

This application is a 35 U. S. C. § 371 National Phase conversion of International (PCT) Patent Application No. PCT/CN2016/112820, filed on Dec. 29, 2016, which claims the priority of Chinese Patent Application No. 201610377865.9 filed on May 31, 2016 with a title of "Left-Right Door Opening Mechanism and Refrigerator", the entire content of which is hereby incorporated in this application by reference. The PCT International Patent Application was filed and published in Chinese.

TECHNICAL FIELD

The present invention relates to the technical field of household appliances, and in particular, to a left-right door opening mechanism and a refrigerator.

BACKGROUND

At present, for a commercially available refrigerator, a door is generally opened from the left side, and also has the function of opening from the right side, but it is necessary for an after-sales engineer to visit to replace a hinge or change the position of the hinge. This method has higher skill requirements for after-sales maintenance personnel and also reduces the use experience of a user.

In view of the above problems, it is necessary to provide a left-right door opening mechanism and a refrigerator.

SUMMARY

In view of the defects of the prior art, the technical problem to be solved by the present invention is to provide a left-right door opening mechanism and a refrigerator, which are capable of opening a door of the refrigerator from the left side or the right side.

In order to solve the above technical problem, the technical solution of the present invention is implemented as follows.

A left-right door opening mechanism comprises a hinge module arranged on a refrigerator door body and a transmission module arranged on a refrigerator cabinet body, wherein the transmission module comprises a transmission bottom plate, two first gears oppositely arranged on the transmission bottom plate, a transmission rack which is in transmission through the first gears, and second gears which are in transmission with the first gears respectively; the transmission rack is guided and limited by the second gears; the hinge module comprises a hinge bottom plate and two hinges oppositely arranged on the hinge bottom plate; the hinges are in transmission with the first gears; when the two hinges are respectively meshed with the first gears, the door body is locked; when the hinge on one side is disengaged from the first gear but the hinge on the other side is still meshed with the other first gear, the door body is opened.

As an improvement of the present invention, the hinge and the second gear are located on two sides of each of the first gears, and the second gear is located inside each of the two first gears; the hinge is located outside each of the first gears.

As a further improvement of the present invention, the first gear is rotatably mounted on the transmission bottom plate by means of a first rotating shaft; the first gear comprises a first tooth portion meshed with the corresponding hinge, and a second tooth portion meshed with the corresponding second gear and the corresponding transmission rack.

As a further improvement of the present invention, the second gear is rotatably mounted on the transmission bottom plate by means of a second rotating shaft; the second gear comprises a third tooth portion meshed with the first gear; the second rotating shaft is located at a non-center position of the second gear.

As a further improvement of the present invention, a limiting member is arranged on the transmission rack; a sliding groove for accommodating the limiting member is arranged at the upper part of the second gear.

As a further improvement of the present invention, a fourth tooth portion which is meshed with the first gear is arranged on each of the two ends of the transmission rack; a fixing portion is further arranged outside the fourth tooth portion; the first gear is provided with an accommodating groove for accommodating the fixing portion.

As a further improvement of the present invention, the hinge is rotatably mounted on the hinge bottom plate by means of a third rotating shaft; the hinge comprises a fifth tooth portion which is meshed with the corresponding first gear.

As a further improvement of the present invention, the hinge comprises a hinge body and an extension portion which extends outwards from the hinge body; the hinge body is rotatably mounted on the hinge bottom plate; the fifth tooth portion is arranged at the end part of the extension portion; the transmission bottom plate is fixedly provided with a slot for limiting the extension portion.

As a further improvement of the present invention, a guiding slider is arranged on the transmission bottom plate; the guiding slider is provided with a guiding groove used for guiding the transmission rack along a transmission direction.

Correspondingly, the present invention further discloses a refrigerator which comprises the above-mentioned left-right door opening mechanism.

The present invention has the following beneficial effects.

The rotating shaft is arranged on the door body, and the door can be opened from the left side or the right side, without making any adjustment.

It is ensured that the door opening and closing process is smooth and free of blocking and impact noise. The door body is unlikely to fall off during the opening and closing process, and provides an excellent use experience for a user.

DETAILED DESCRIPTION

To make the objects, technical solutions and advantages of the present invention clearer, the specific embodiments of the present invention are described in detail with reference to the accompanying drawings. Examples of these preferred embodiments are given in the accompanying drawings. The embodiments of the present invention shown in the accompanying drawings and described based on the accompanying drawings are only exemplary and are not intended to limit the present invention.

The terms "left", "right", "left side", "right side", and the like as used here, which denote spatial relative positions, describe the relationship of a component relative to another component in the accompanying drawings for the purpose of illustration. The terms of the spatial relative positions may be intended to include different orientations of the device in use or operation other than the orientations shown in the accompanying drawings. For example, the units that are described as being located on the "right side" of other units or features will be located on the "left side" of other units or features if the device in the accompanying drawings is turned upside down. Thus, the exemplary term "right side" can encompass both the orientations of left side and right side. The device may be otherwise oriented (rotated by 90 degrees or facing other directions) and the space-related descriptors used here are interpreted accordingly.

Figure 1:
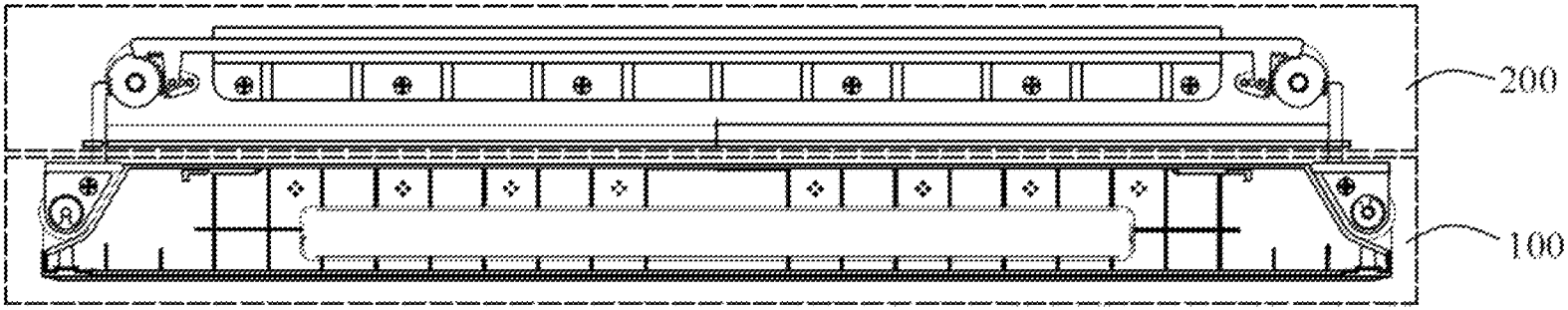
FIG. 1 illustrates a planar schematic structural diagram of a left-right door opening mechanism in a specific embodiment of the present invention.

As shown in FIG. 1, a left-right door opening mechanism in a specific embodiment of the present invention comprises a hinge module 100 arranged on a refrigerator door body and a transmission module 200 arranged on a refrigerator cabinet body. The hinge module 100 and the transmission module 200 are mounted by means of components such as hinges and gears provided on two ends. The hinge module 100 and the transmission module 200 each have at least one end that is rotatably fixed, such that the door of the refrigerator may be opened from the left side or the right side.

Figure 2:
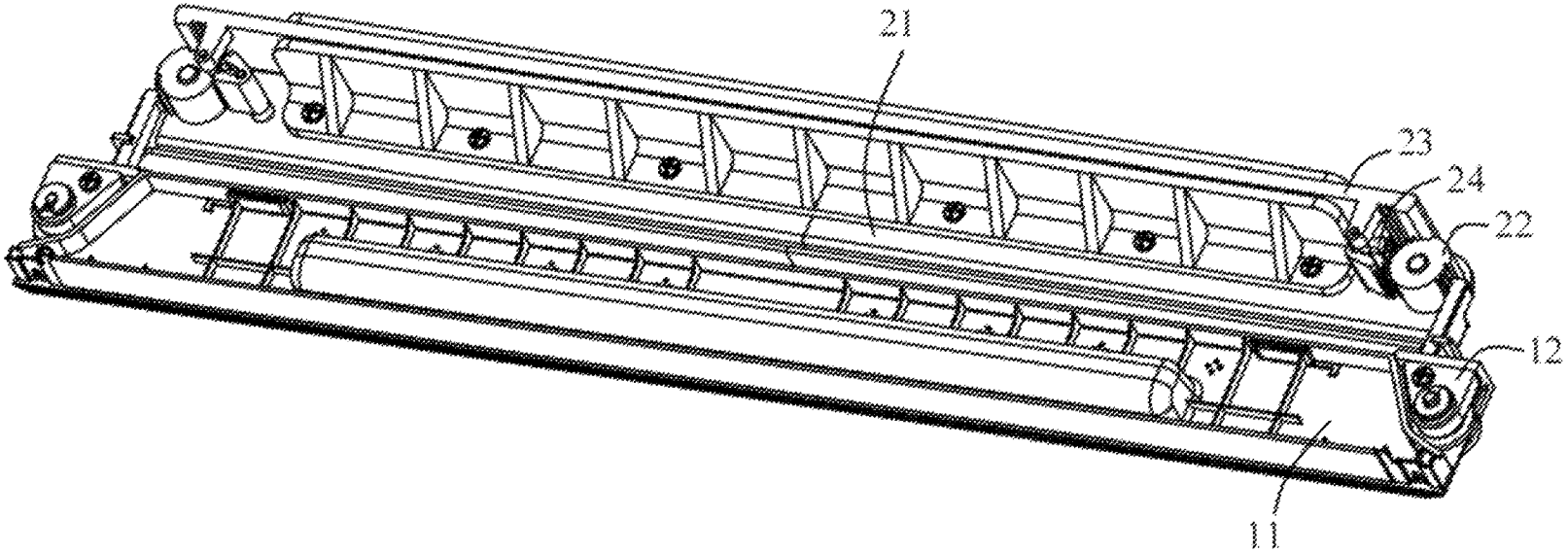
FIG. 2 illustrates a stereoscopic schematic structural diagram of a left-right door opening mechanism in a specific embodiment of the present invention.
Figure 3:
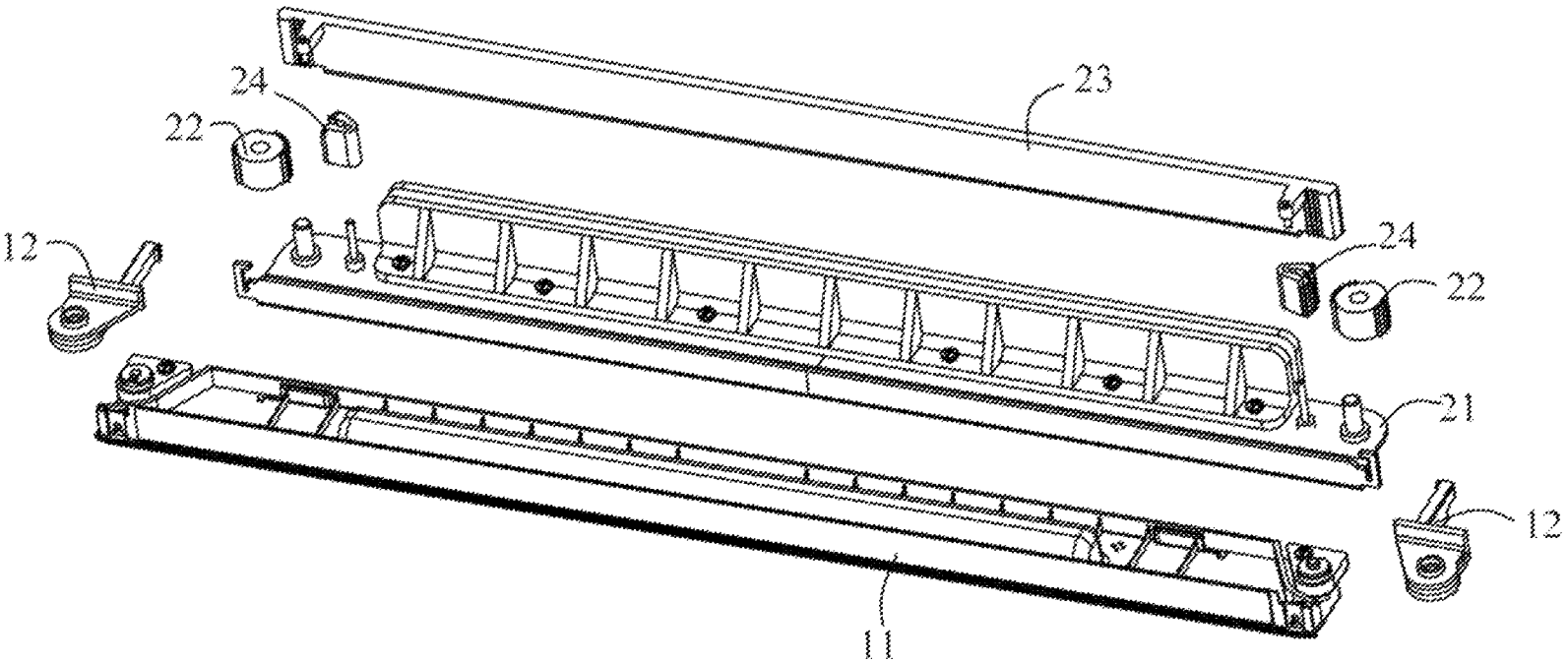
FIG. 3 illustrates an exploded schematic structural diagram of a left-right door opening mechanism in a specific embodiment of the present invention.

As shown in FIGS. 2 and 3, the transmission module 200 in the present embodiment comprises a transmission bottom plate 21, two first gears 22 oppositely arranged on the transmission bottom plate, a transmission rack 23 which is in transmission through the first gears, and second gears 24 which are in transmission with the first gears respectively. The transmission rack 23 is guided and limited by the second gears 24. The hinge module 100 comprises a hinge bottom plate 11 and two hinges 12 oppositely arranged on the hinge bottom plate. The hinges 12 are in transmission with the first gears 22. When the two hinges 12 are respectively meshed with the first gears 22, the door body is locked. When the hinge 12 on one side is disengaged from the first gear 22 but the hinge on the other side is still meshed with the other first gear, the door body is opened.

The left-right door opening mechanism in the present embodiment will be described in detail below in conjunction with specific components in the hinge module and the transmission module.

Figure 4:
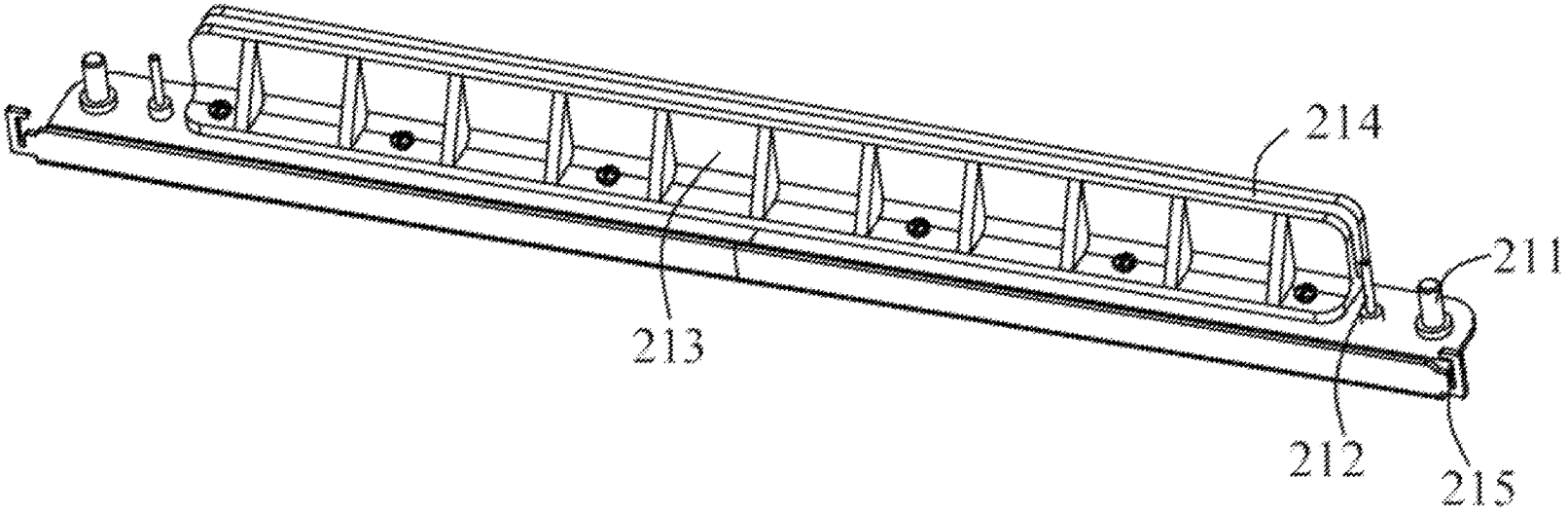
FIG. 4 is a stereoscopic schematic structural diagram of a transmission bottom plate in a specific embodiment of the present invention.

As shown in FIG. 4, the transmission module 200 in the present embodiment comprises an elongated transmission bottom plate 21. A first rotating shaft 211 and a second rotating shaft 212 are respectively arranged on the left and right sides of the transmission bottom plate 21. The first rotating shaft 211 is located outside the second rotating shaft 212. The first gear 22 and the second gear 24 are rotatably mounted on the transmission bottom plate 21 by means of the first rotating shaft 211 and the second rotating shaft 212, respectively. In addition, the first gear 22 and the second gear 24 are meshed with each other.

Figure 5:
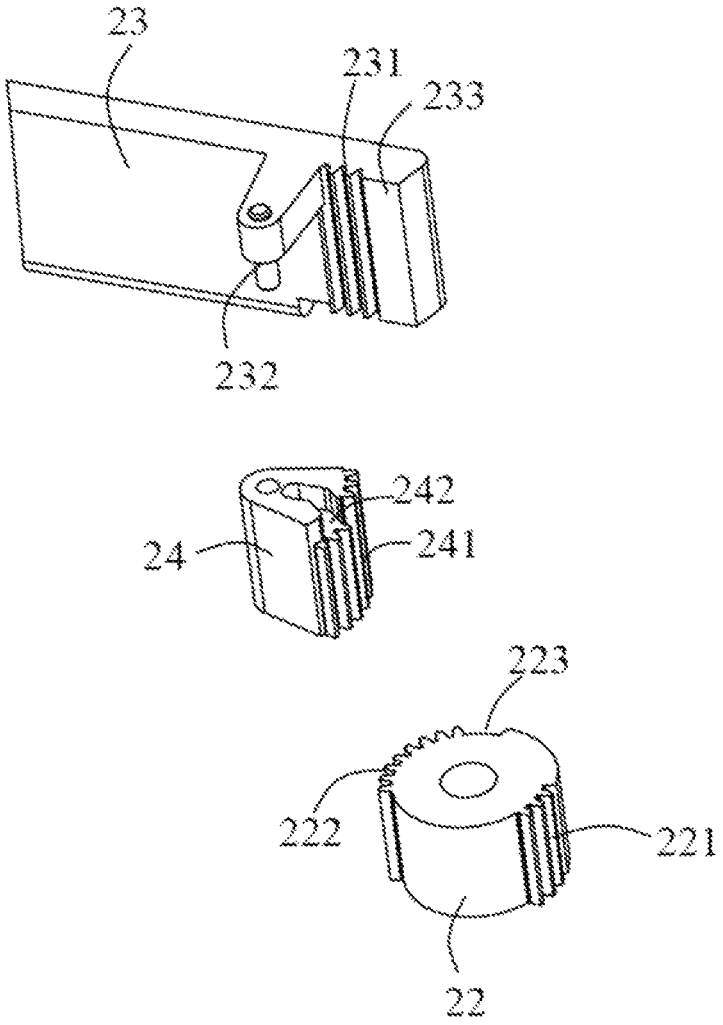
FIG. 5 illustrates a stereoscopic schematic structural diagram of a first gear, a second gear and a transmission rack in a specific embodiment of the present invention.

As shown in FIG. 5, the first gear 22 is circular and is rotatably mounted on the transmission bottom plate 21 by means of the first rotating shaft 211. The first rotating shaft 211 is mounted at a center position of the first gear 22. The first gear 22 comprises a first tooth portion 221 meshed with the corresponding hinge and a second tooth portion 222 meshed with the corresponding second gear and the corresponding transmission rack.

It should be understood that the first tooth portion 221 and the second tooth portion 222 which are separated from each other are arranged outside the first gear 22 in the present embodiment. In other embodiments, the first tooth portion 221 and the second tooth portion 222 may also be arranged as a whole, and the purpose of transmission with the hinge, the second gear and the transmission rack may also be achieved.

The second gear 24 is arranged in a fan shape, and is rotatably mounted on the transmission bottom plate 21 by means of the second rotating shaft 212. The second rotating shaft 212 is mounted at a non-center position of the second gear 24. The second gear 24 comprises a third tooth portion 241 meshed with the first gear. The third tooth portion 241 is arranged on the fan-shaped surface of the second gear 24. A sliding groove 242 which is in an approximately arc shape is also arranged on the top of the second gear 24.

In the present embodiment, the second gear 24 is higher than the first gear 22, but the bottom surface of the sliding groove 242 is arranged at the same height as the top surface of the first gear 22. Moreover, the sliding groove 242 is configured to have an opening, so that the assembly of the transmission rack 23 and the second gear 24 can be performed quickly. Of course, in other embodiments, the sliding groove may also be configured to have no opening, and the heights of the first gear 22 and the second gear 24 may also be equal or the first gear 22 is higher than the second gear 24, which will not be described here in detail.

The transmission rack 23 is longitudinal. A fourth tooth portion 231 which is meshed with the corresponding first gear is arranged on each of the two ends of the transmission rack 23. The fourth tooth portion 231 and the second tooth portion 222 on the first gear 22 are meshed with each other. Further, the transmission rack is provided with a limiting member 232 which is perpendicular to the top surface of the second gear 24. When the first gear and the second gear are meshed to rotate, the transmission rack rotates along with the first gear, and the limiting member 232 on the transmission rack moves in the sliding groove 242 on the second gear 24.

In the present embodiment, the transmission rack 23 is higher than the first gear 22 and the second gear 24, such that the limiting member 232 of the transmission rack 23 may be vertically assembled into the sliding groove 242 on the second gear 24.

Further, in order to keep the transmission rack 23 and the first gear 22 fixed, the first gear 22 is further provided with an accommodating groove 223 on the side of the second tooth portion 222. The transmission rack 23 is provided with a fixing portion 233 outside the fourth tooth portion 231. The fixing portion 233 has a shape corresponding to the shape of the accommodating groove 223. After the transmission rack 23 is meshed with the first gear 22 by means of the second tooth portion 222 and the fourth tooth portion 231, the fixing portion 233 is fixedly accommodated inside the accommodating groove 223, thereby fixing the end part of the transmission rack.

Figure 6:
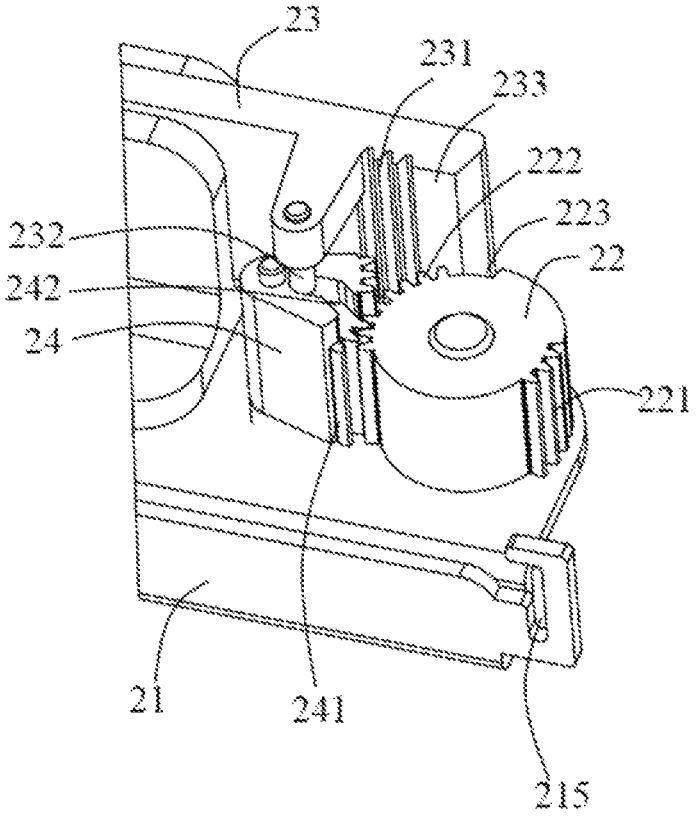
FIG. 6 illustrates an assembly schematic structural diagram of a transmission module in a specific embodiment of the present invention.

FIG. 6 illustrates an assembly schematic diagram of the transmission module. The assembly and transmission principle of the transmission module is specifically as follows.

The first gear 22 and the second gear 24 are rotatably mounted at the end part of the transmission bottom plate 21 respectively by means of the first rotating shaft 211 and the second rotating shaft 212. A pair of first gear 22 and second gear 24 is arranged on each of the two sides of the transmission bottom plate 21. The first gear 22 and the second gear 24 are meshed with each other by means of the second tooth portion 222 and the second tooth portion 241. The first gear 22 can drive the second gear 24 to rotate along the second rotating shaft 212 while rotating along the first rotating shaft 211.

Meanwhile, the transmission rack 23 and the two first gears 22 are meshed with each other by means of the second tooth portion 222 and the fourth tooth portion 231, respectively. The first gear 22 on one side, which is in rotation, can drive the transmission rack 23 to move horizontally, so that the transmission rack can drive the first gear 22 on the other side to rotate in the same direction. In order to ensure the relative position of the transmission rack 23 and the first gear 22, the fixing portion 233 at the end part of the transmission rack 23 and the accommodating groove 223 on the first gear 22 are used to limit the transmission rack 23 and the first gear 22.

During the transmission of the transmission rack 23, the limiting member 232 on the transmission rack 23 is always located in the sliding groove 242 on the second gear 24 to ensure that the transmission rack 23 is not disengaged from the transmission position. Because the second gear rotates around the second rotating shaft, and meanwhile the transmission rack is linearly driven, the shape of the sliding groove 242 is substantially in an arc shape. In addition, the sliding groove 242 is arranged between the second rotating shaft and the third tooth portion, thereby providing a sliding track for the limiting member 232 on the transmission rack 23.

Preferably, as shown in FIGS. 1 and 3, in the present embodiment, in order to limit a transmission line of the transmission rack 23, a guiding slider 213 is further arranged on the transmission bottom plate 21 and located between the two second gears. The guiding slider 213 is provided with a guiding groove 214 for guiding the transmission rack in the transmission direction. In the present embodiment, the guiding slider 213 is fixed on the transmission bottom plate 21 by means of a plurality of nuts. Of course, in other embodiments, the mounting manners, such as buckling may be adopted, or the transmission bottom plate and the guiding slider may be integrally formed, which will not be described here.

Figure 7:
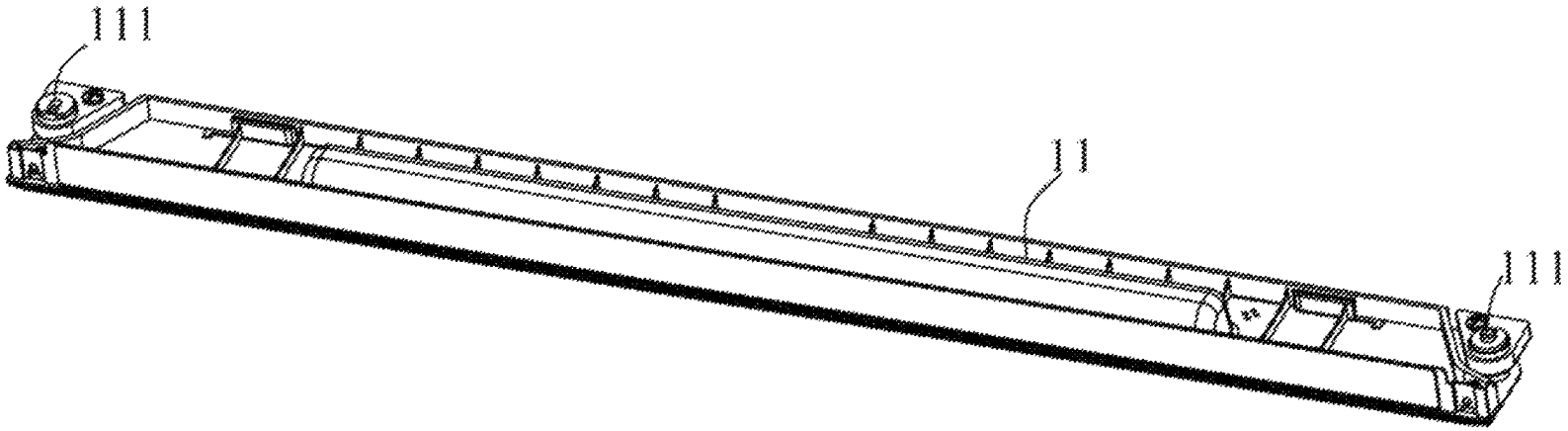
FIG. 7 illustrates a stereoscopic schematic structural diagram of a hinge bottom plate in a specific embodiment of the present invention.

As shown in FIG. 7, the hinge module 100 in the present embodiment comprises an elongated hinge bottom plate 11. Third rotating shafts 111 which are symmetrically distributed are arranged on two ends of the hinge bottom plate 11 respectively. A hinge which is used for connecting the hinge bottom plate and the transmission module is rotatably mounted on each of the third rotating shafts 111.

Figure 8:
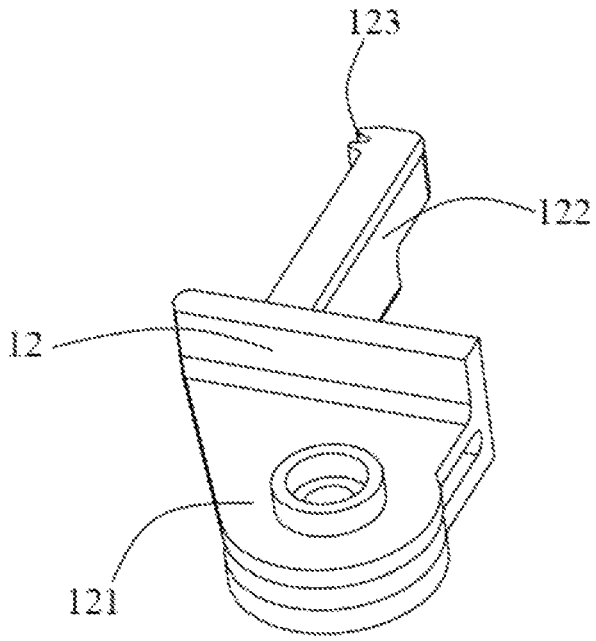
FIG. 8 illustrates a stereoscopic schematic structural diagram of a hinge in a specific embodiment of the present invention.

As shown in FIG. 8, the hinge 12 comprises a hinge body 121 and an extension portion 122 which extends outwards from the hinge body 121. The hinge body 121 is rotatably mounted on the hinge bottom plate 11. A fifth tooth portion 123 is arranged on the side of the end part of the extension portion 122. The fifth tooth portion 123 on the hinge 12 and the first tooth portion 221 of the first gear 22 on the transmission bottom plate 21 are meshed with each other.

When the user opens the door from one side, the hinge module on one side is pulled. The hinge 12 on this side in this case moves outwards by means of the fifth tooth portion 123. The fifth tooth portion 123 and the first tooth portion 221 are meshed with each other to drive the first gear 22 on the transmission module to rotate around the first rotating shaft 211. After the hinge 12 moves outwards by a distance, the fifth tooth portion 123 and the first tooth portion 221 are separated from each other. That is, the hinge 12 and the first gear 22 are separated from each other, the first gear 22 stops rotating, and the hinge and the hinge body on the other side are rotatably arranged to achieve the purpose of opening the door from one side.

Further, as shown in FIG. 6, in the present embodiment, a slot 215 is fixedly arranged on each of the two ends of the transmission bottom plate 21 and used for limiting the extension portion. The slots 215 are formed in a manner of buckling. The hinge 12 moves in a direction (perpendicular to a movement direction of the transmission rack) of the slot 215 while moving relative to the first gear 22.

Figure 9:
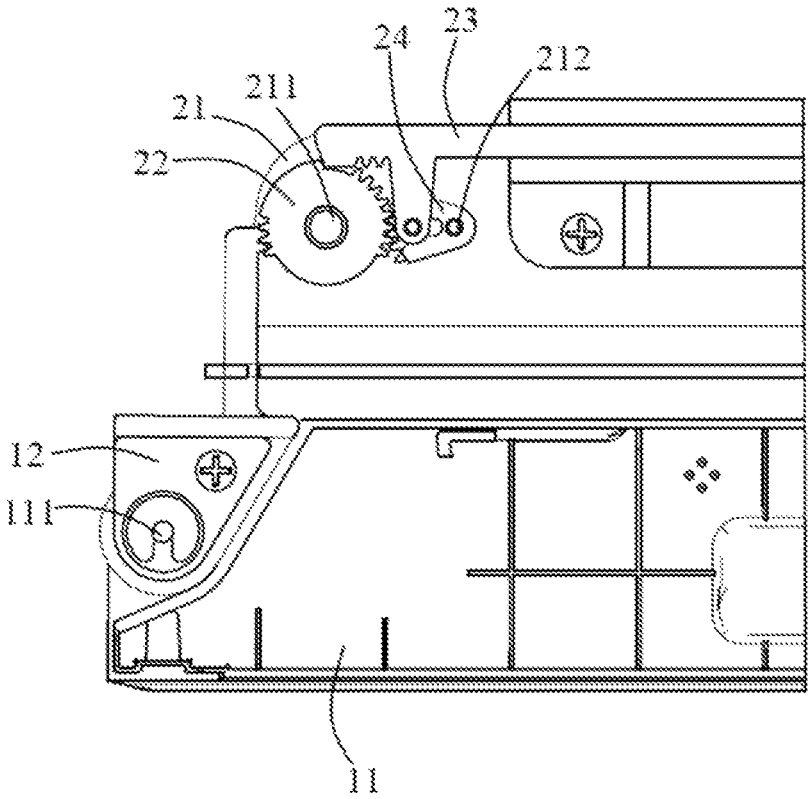
FIG. 9 illustrates a state diagram when the left-right door opening mechanism is locked from the left side in a specific embodiment of the present invention.
Figure 10:
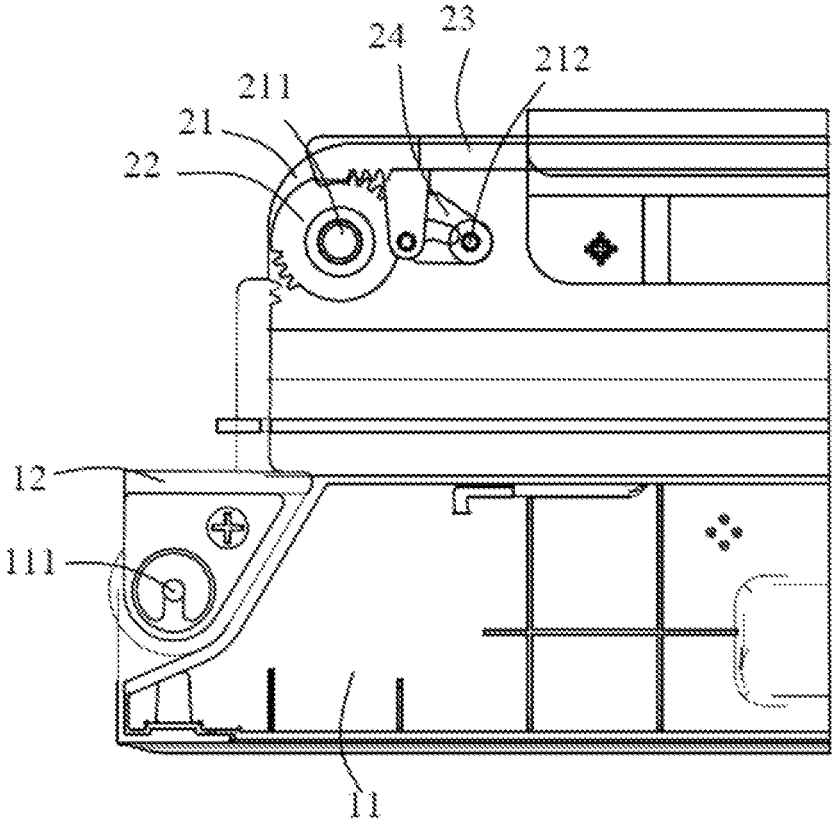
FIG. 10 illustrates a state diagram when the left-right door opening mechanism is opened from the left side in a specific embodiment of the present invention.

As shown in FIGS. 9 and 10, the present embodiment will be further described by taking the door which is opened from the left side as an example.

By reference to FIG. 9 and as shown in FIGS. 1 to 8, the left-right door opening mechanism is in a locked state. The hinge module is clamped with the transmission module. The hinge 12 is rotatably mounted on the hinge bottom plate 11. The first gear 22, the second gear 24 and the transmission rack 23 are mounted on the transmission bottom plate 21. The hinge 12 on the left side is meshed with the first tooth portion 221 on the first gear 22 by means of the fifth tooth portion 123 at the front end. The second tooth portion 222 of the first gear 22 is meshed with the third tooth portion 221 of the second gear 24. Meanwhile, the fourth tooth portion 231 at the left end of the transmission rack 23 is not meshed with the first tooth portion 221 of the first gear 22. The fixing portion 233 at the left end of the transmission rack 23 is located in the accommodating groove 223 of the first gear 22. The limiting member 232 of the transmission rack 23 is vertically assembled in the sliding groove 242 on the second gear 24. Similarly, the assembly relationship on the right side of the left-right door opening mechanism is symmetric with that on the left side, and will not be described here again.

When the door is opened from the left side, the hinge bottom plate 11 on the left side is pulled to drive the hinge 12 on the left side to move outwards. The hinge 12 on the left side is meshed with the first tooth portion 221 by means of the fifth tooth portion 123 to drive the first gear 22 to move anticlockwise. The second tooth portion 222 on the first gear 22 and the fourth tooth portion 231 on the transmission rack 23 are meshed to further drive the transmission rack 23 to move leftwards. Meanwhile, the second tooth portion 222 of the first gear 22 and the third tooth portion 241 of the second gear 24 are meshed with each other. The first gear 22 may drive the second gear 24 to rotate clockwise. The limiting member 232 on the transmission rack 23 moves leftwards along the sliding groove 242.

When the transmission rack 23 moves leftwards, the fourth tooth portion 231 on the right side of the transmission rack 23 drives the first gear 22 on the right side to rotate clockwise. The first gear 22 simultaneously drives the second gear 24 on the right side to rotate clockwise, and the hinge 12 on the right side moves inwards.

It can thus be seen that the hinge 12 on the left side gradually moves outwards till the hinge 12 is disengaged from the first gear 22 on the left side. The left-right door opening mechanism on the left side is in an opened state, and the structure thereof is shown in FIG. 10. The hinge 12 on the right side in this case gradually moves inwardly, and is further locked with the first gear 22 on the right side. The third rotating shaft on the hinge bottom plate on the right side serves as a central shaft for the refrigerator door body to rotate.

When the door is locked from the left side, the left side of the door body is pushed. The hinge 12 on the left side moves inwards until the first gear 22 and the hinge 12 are gradually meshed. The transmission direction of the first gear 22, the second gear 24, and the transmission rack 23 on the left side is opposite to that when the door is opened. The transmission rack 23 gradually moves rightwards until the refrigerator door body is fitted to the refrigerator cabinet body. The state of the left-right door opening mechanism in this case is restored to the state shown in FIGS. 1 and 9.

Similarly, when the door is opened from the right side by the left-right door opening mechanism, the hinge on the right side moves outwards. The hinge on the left side in this case will move inwards reversely till being gradually locked. The third rotating shaft on the hinge bottom plate on the left side serves as a central shaft for the refrigerator door body to rotate. When the lock is locked from the right side, the hinge on the right side moves inwards, and the transmission rack gradually moves leftwards till being restored to the locked state. The transmission relationship of the left-right door opening mechanism when the door is opened or locked from the right side is similar to that of opening or locking the door from the left side, and will not be described here.

The left-right door opening mechanism in the present embodiment is described by taking a refrigerator as an example. In other embodiments, the left-right door opening mechanism may be applied to any device comprising a door body and a refrigerator body, such as a wine cabinet, etc., and will not be described in detail here.

As can be seen from the above technical solution, the present invention has the following beneficial effects.

The rotating shaft is arranged on the door body, and the door can be opened from the left side or the right side, without making any adjustment.

It is ensured that the door opening and closing process is smooth and free of blocking and impact noise. The door body is unlikely to fall off during the opening and closing process, and provides an excellent use experience for a user.

It should be understood that although the description is described based on the embodiments, not every embodiment includes only one independent technical solution. This statement manner of the description is only for clarity. Those skilled in the art should treat the description as a whole, and technical solutions in all of the embodiments may also be properly combined to form other embodiments that will be understood by those skilled in the art.

The above detailed description only aims to specifically illustrate the feasible embodiments of the present invention, and is not intended to limit the protection scope of the present invention. Equivalent embodiments or modifications thereof made without departing from the spirit of the present invention shall fall within the protection scope of the present invention.

What is claimed is:

1. A left-right door opening mechanism, comprising a hinge module arranged on a refrigerator door body and a transmission module arranged on a refrigerator cabinet body, wherein the transmission module comprises a transmission bottom plate, two first gears oppositely arranged on the transmission bottom plate, a transmission rack which is in transmission through the first gears, and second gears which are in transmission with the first gears respectively; the transmission rack is guided and limited by the second gears; the hinge module comprises a hinge bottom plate and two hinges oppositely arranged on the hinge bottom plate; the hinges are in transmission with the first gears; when the two hinges are respectively meshed with the first gears, the door body is locked; when the hinge on one side is disengaged from the first gear but the hinge on the other side is still meshed with the other first gear, the door body is opened.

2. The left-right door opening mechanism according to claim 1, wherein the hinge and the second gear are located on two sides of each of the first gears, and the second gear is located inside each of the two first gears; the hinge is located outside each of the first gears.

3. The left-right door opening mechanism according to claim 2, wherein the first gear is rotatably mounted on the transmission bottom plate by means of a first rotating shaft; the first gear comprises a first tooth portion meshed with the corresponding hinge, and a second tooth portion meshed with the corresponding second gear and the corresponding transmission rack.

4. The left-right door opening mechanism according to claim 2, wherein the second gear is rotatably mounted on the transmission bottom plate by means of a second rotating shaft; the second gear comprises a third tooth portion meshed with the first gear; the second rotating shaft is located at a non-center position of the second gear.

5. The left-right door opening mechanism according to claim 4, wherein a limiting member is arranged on the transmission rack; a sliding groove for accommodating the limiting member is arranged at the upper part of the second gear.

6. The left-right door opening mechanism according to claim 2, wherein a fourth tooth portion which is meshed with the first gear is arranged on each of the two ends of the transmission rack; a fixing portion is further arranged outside the fourth tooth portion; the first gear is provided with an accommodating groove for accommodating the fixing portion.

7. The left-right door opening mechanism according to claim 2, wherein the hinge is rotatably mounted on the hinge bottom plate by means of a third rotating shaft; the hinge comprises a fifth tooth portion which is meshed with the corresponding first gear.

8. The left-right door opening mechanism according to claim 7, wherein the hinge comprises a hinge body and an extension portion which extends outwards from the hinge body; the hinge body is rotatably mounted on the hinge bottom plate; the fifth tooth portion is arranged at the end part of the extension portion; the transmission bottom plate is fixedly provided with a slot for limiting the extension portion.

9. The left-right door opening mechanism according to claim 1, wherein a guiding slider is arranged on the transmission bottom plate; the guiding slider is provided with a guiding groove used for guiding the transmission rack along a transmission direction.

10. A refrigerator, comprising the left-right door opening mechanism according to claim 1.

* * * * *